United States Patent [19]

Sigler

[11] 4,159,839

[45] Jul. 3, 1979

[54] TABLEWARE IMPLEMENT

[76] Inventor: Eston D. Sigler, 1506 1st St., Lake Charles, La. 70601

[21] Appl. No.: 886,875

[22] Filed: Mar. 15, 1978

[51] Int. Cl.[2] ..... A47G 21/00

[52] U.S. Cl. ..... 294/1 R; 15/236 R; 30/142

[58] Field of Search ..... 294/1 R, 7, 49, 51, 294/54, 55; D7/99, 102, 104, 141, 148, 152; 15/236 R; 30/1, 142, 169, 324, 353, 357

[56] References Cited

U.S. PATENT DOCUMENTS

| | | | |
|---|---|---|---|
| D. 175,304 | 8/1955 | Gorin | D7/102 |
| 339,514 | 4/1886 | Averill | 30/142 |
| 725,628 | 4/1903 | Ressler | D7/102 X |
| 944,091 | 12/1909 | Harn | 30/142 |
| 1,211,062 | 1/1917 | Bowman | 30/142 X |
| 2,243,236 | 5/1941 | Walsh | 294/1 R |
| 2,602,686 | 7/1952 | Raines | 294/1 R |
| 2,799,086 | 7/1957 | Tupper | 30/142 |

*Primary Examiner*—Johnny D. Cherry

[57] ABSTRACT

An implement of tableware adapted to work in conjunction with conventional silverwave to clear all food from the plate. The tableware implement comprises a bowl head having a front scooped, pushing surface, peripherally defined by variously contoured scraping edges, and a handle attached to the rear of the bowl head. The variously contoured edges serve as scrapers, at least one edge is flat to maximally contact the surface of a flat plate, and at least one other edge is curved to maximally conform to the rounded bottom surface of cups and bowls.

3 Claims, 6 Drawing Figures

TABLEWARE IMPLEMENT

BACKGROUND OF THE INVENTION

1. Field of the Invention

This invention relates to a tableware implement designed to be used in conjunction with conventional silverware to facilitate the removal of all food from plates, cups, soup bowls and the like. The term "silverware" should be construed as applying to all eating implements such as knives, forks and spoons whether they be constructed of metal, plastic, wood or ceramic materials.

2. Description of the Prior Art

| | | |
|---|---|---|
| 339514 | Averill | April 6,1886 |
| 1,211,062 | Bowman | January 2, 1917 |
| 2,243,236 | Walsh | May 27, 1941 |
| 2,602,686 | Raines | July 8, 1952 |

Conventional silverware is somewhat inadequate to the task of completely removing such edibles as beans, rice, diced vegetables, bits of lettuce, spaghetti and the like from plates, cups and bowls. The Walsh patent cited above discloses a flat headed tableware implement adapted to push food onto a fork. Raines discloses a food pushing implement with laterally curved wings to surround and push food onto a spoon. Both the Raines and Walsh devices are equipped with flat lower edges for scraping surfaces. Bowman and Averill both disclose spoons with the edges modified to perform stirring and scraping functions.

SUMMARY OF THE INVENTION

Most often a portion of the food served on a plate or in a bowl cannot be retrieved by the diner. This is especially true of slippery foods like noodles, beans, diced vegetables, and rice, whether they are on a plate or in the bottom of the soup bowl.

At the present time when the nation is engaged in public debate on the issue of energy, and in the surveying of the earths limited natural resources, the realization is dawning that the years of waste, the throw-away philosophy, must come to an end. All means of conservation, on every scale, becomes significant. Food is a prime source of energy, and the more efficient consumption of food is a prime objective of the present device.

The present tableware implement which aids in clearing food from the plate, serves by so doing to satisfy the diner, and compliment the cook.

The physical appearance of the device is so designed and constructed as to complement or match standard silverware service, and it may be made of the standard materials used in conventional silverware. It enables the user to clear the plate in a graceful and decorous manner without resorting to fingers or "bread mopping".

These together with other objects and advantages which will become subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
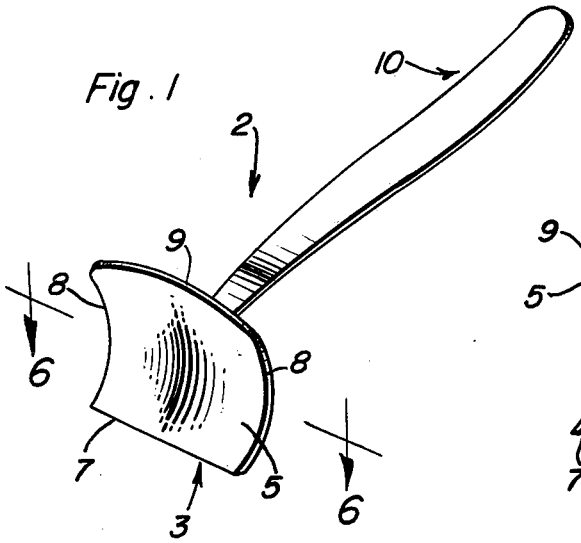
FIG. 1 is a front perspective view of the tableware implement.
Figure 2:
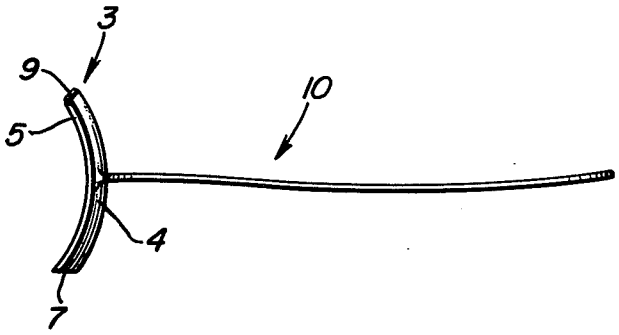
FIG. 2 is a side elevational view of the device.
Figure 3:
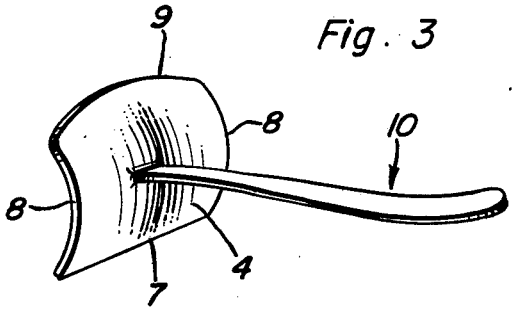
FIG. 3 is a rear perspective view of the tableware implement.

Referring to the drawings in detail, the tableware implement 2 is made of a bowl head 3 having an outer convex surface 4, and an inner concave surface 5. The handle 10 is secured to the outer convex suface 4. The inner concave surface 5 of the bowl head 3 serves as a scoop as well as a pushing surface.

The bowl head 3 is bowed in both its longitudinal and transverse extents. Section line 6—6 which is shown in FIG. 1 is taken along the median of the bowl head in the direction of greatest longitudinal extent. This median line 6—6 serves as a frame of reference for purposes of description, and is the locus of all the points of greatest transverse curvature of the bowl. The side elevational view of FIG. 2 of the drawings shows the transverse curvature or bowing. The sectional view of FIG. 6 shows the longitudinal bowing. The multiple peripheral edges 7-8-8-9 of the bowl head 3 define its boundaries, and are variously contoured to provide scraping means. For example the edge 7 is relatively flat as shown in FIGS. 1-5 inclusive, and edge 7 appears in FIG. 1 to be parallel to the median section line 6—6. The edge 9 opposite edge 7 is outwardly curved or arched to conform to the concavely rounded interior surfaces of bowls and mugs, see FIG. 4. Edges 8 which extend between edges 7 and 9 lie in parallel planes with respect to each other, and may also be used as scraping edges on either flat or curved surfaces. When edges 8 are held so that median line 6—6 of the bowl head 3 is perpendicular to a flat surface, then maximum contiguity and effectiveness for scraping flat surfaces is achieved. By varying the angularity of median section line 6—6 with respect to the horizontal, the scraping of curved surfaces by edges 8 is effected. It is the users choice as to which scraping edge of the bowl head be employed on which surface.

The handle 10 of the tableware implement has been shown as preferrably elongated and rigidly attached to the convex surface of the bowl head 3. The attachment is at a point between and equidistant from edges 8 and along a ridge which coincides with the median section line 6—6 as shown in FIG. 1. The median line 6—6 as previously indicated, constitutes the locus of all points of maximum curvature in the transverse bowing of the bowl head. The implement 2 may be made of metal, plastic, wood, or ceramic material in the manner of conventional silverware. The handle, herein shown as elongated, may be in the form of a closed loop, knob or the like.

Figure 4:
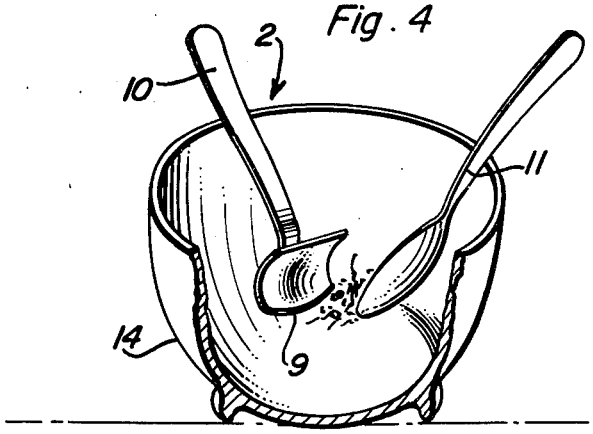
FIG. 4 is a perspective view of the implement shown working in conjunction with a spoon in a bowl.

In FIG. 4 the tableware implement 2 is shown working in conjunction with a conventional spoon 11, in a mug or bowl 14, with the curved edge 9 acting as a scraping edge for the interior rounded bottom of the bowl.

Figure 5:
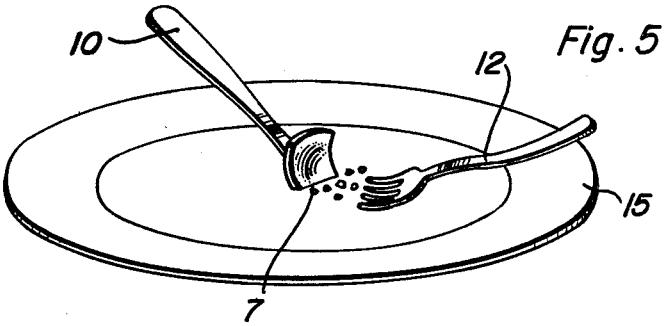
FIG. 5 is a perspective view of the implement working in conjunction with a fork on a plate.
Figure 6:
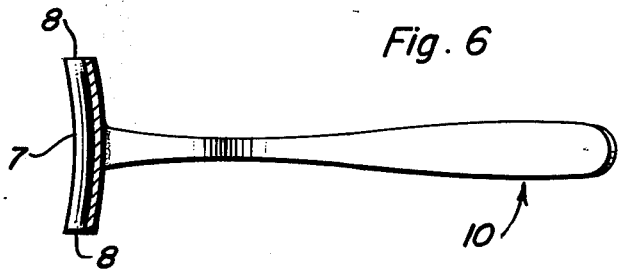
FIG. 6 is a sectional view of the implement taken on the line 6—6 of FIG. 1, looking in the direction of the arrows.

In FIG. 5 of the drawings the tableware implement 2 is shown placing food from a flat plate 15 onto a fork 12, the flat edge 7 acting as the scraping surface.

The tableware implement has a variety of scraping edges, a bowl head for scooping the food together and a handle for pushing the food gathered in the bowl head onto a conventional eating implement for conveyance into the mouth of the diner.

The forgoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A tableware implement having a bowl head with a concave front face, and a rear convex face, the bowl head boundary being defined by multiple peripheral edges varyingly contoured to serve as scraping edges, wherein one peripheral edge is flattened to conform to the surface of a plate, and another peripheral edge is arched to conform to the concave rounded inner surface of a bowl, and a handle rigidly attached to the convex face of the bowl head at a substantially central point on the bowl head removed from all peripheral edges, said handle extending in a plane substantially normal to the said point of attachment allowing ready rotation of the bowl head and selective use of the varyingly contoured edges.

2. A tableware implement as defined in claim 1 wherein the flattened and arched edges are opposite each other, and wherein a second pair of opposed edges lie in parallel planes and extend between the said flattened edge, and the said arched edge, the first named pair of edges being of greater longitudinal extent than the second, and the said substantially central point of attachment lying at the juncture of the lines which bisect the first and second pair of edges respectively.

3. A tableware implement comprising a bowl head and a handle, the bowl head having a longitudinal and transverse extent and being bowed in its transverse extent, the peripheral edges of the bowl head being variously contoured to serve as scraping edges, one edge being flattened and parallel to the longitudinal extent, the opposite edge being arched, the said handle being rigidly attached to the outer surface of the bowl head at a point midway along the median line between the said opposite edges, and the said handle extending in a plane normal to the point of attachment.

* * * * *